428-919 SR
9/5/78 XR 4,110,941

United States Patent [19]
Scott

[11] 4,110,941
[45] Sep. 5, 1978

[54] INSTANT OPEN GOOSE AND DUCK PIT COVER

[76] Inventor: Robert K. Scott, P.O. Box 488, Caldwell, Id. 83605

[21] Appl. No.: 776,973

[22] Filed: Mar. 14, 1977

[51] Int. Cl.[2] ..... E04B 7/16
[52] U.S. Cl. ..... 52/66; 428/919
[58] Field of Search ..... 52/63, 64, 66, 72; 428/919; 89/36 C, 36 F, 36 N; 135/5 R

[56] References Cited

U.S. PATENT DOCUMENTS

| | | | |
|---|---|---|---|
| 1,006,374 | 10/1911 | Erb | 52/66 |
| 2,094,801 | 10/1937 | Mass | 52/64 |
| 2,348,387 | 5/1944 | Hume | 135/5 R |
| 3,018,857 | 1/1962 | Parham | 52/63 |
| 3,566,555 | 3/1973 | Schultz | 52/64 |
| 3,977,134 | 8/1967 | Bogaert | 52/1 |

FOREIGN PATENT DOCUMENTS

| | | | |
|---|---|---|---|
| 434,015 | 1/1912 | France | 52/66 |
| 2,242,672 | 3/1974 | Fed. Rep. of Germany | 52/66 |
| 21,837 of | 1899 | United Kingdom | 428/919 |
| 11,223 of | 1913 | United Kingdom | 52/66 |

*Primary Examiner*—Price C. Faw, Jr.
*Assistant Examiner*—Henry Raduazo
*Attorney, Agent, or Firm*—Paul F. Horton

[57] ABSTRACT

A mechanically built cover for an underground pit which accommodates one or more hunters, and gives maximum freedom of movement and firearm safety. It is preferably used by duck and goose hunters. The cover is built for instant opening, allowing time for the hunters to get their birds within shooting range. This cover will cut down on injured birds which leave the area to die. A designed safety feature of this pit cover is that one man can pull the cord which opens the cover instantly allowing other hunters in the pit to have complete control of their firearms. The pit cover may be camouflaged with whatever is in the hunting area such as corn stalks or any other natural foliages.

5 Claims, 5 Drawing Figures

INSTANT OPEN GOOSE AND DUCK PIT COVER

BACKGROUND OF THE INVENTION

This pit cover allows one or more hunters to shoot in any direction from the pit with no interference from the mechanical pit cover as it is flush with the ground. A feature of the pit is that a hunter may sit at ease instead of being in a standing position allowing room for a heater, if desired, in extremely cold weather. The pit cover includes several making it easy to transport from one area to another. This cover is mechanically designed so that it might be used from year to year with no deterioration from weather conditions.

The camouflage used for the large mesh screen may be natural foliage of the hunting area. This makes it possible to look through the camouflage screen as the birds are approaching the decoys from any direction.

SUMMARY OF THE INVENTION

It is the primary object of my invention to overcome the problems of the prior art cover arrangements for hunters' blinds.

The cover of the present invention is made with two panels consisting of light weight tubing for quick action, held together with one latch. The panels are closed by the pressure of four tension springs, one at the end of each panel coming from the guard rail. The inside of the frame is laced with smooth strand wire making it possible to put the camouflage on as required. One of the nice features of this cover is that it is flush with the ground, and has no wind barrier when it is released.

This invention pertains to an Instant Open Goose and Duck Pit Cover, locatable over a pit, with camouflage means, and is constructed for instant and easy opening. It is ideal for one or more hunters, yet gives maximum freedom of movement which presents maximum firearm safety. Due to the time elements involved in this style of hunting, there have been many accidents and birds lost or crippled when the hunter had to throw his camouflage material out of the way. With this invention these problems are eliminated for when the blind is open there are no interferences or items in the way. It is designed to open instantly with the pull cord.

Also, design of this blind offers the hunter obstruction-free viewing in a full 360° radius of the hunting area.

DESCRIPTION OF THE PREFERRED EMBODIMENTS

Figure 1:
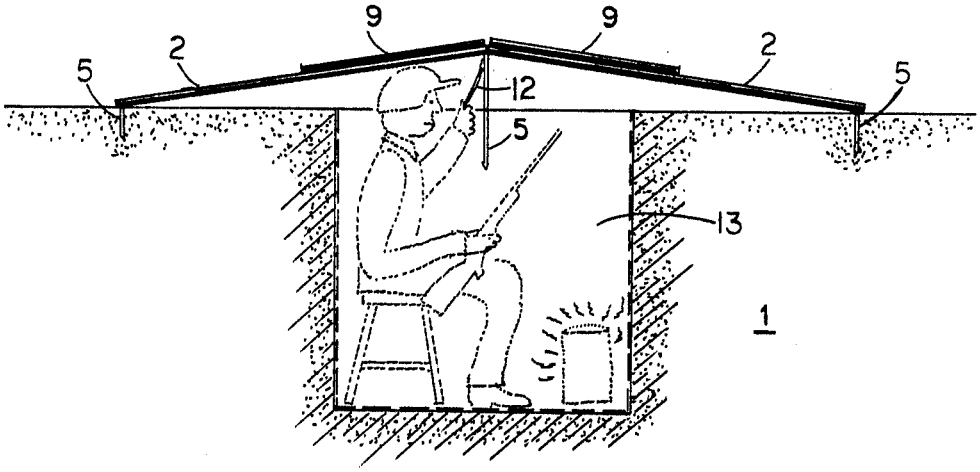
FIG. 1 is an end view of a pit cover ideal for use by several hunters, constructed in accordance with one embodiment of the present invention.

A cover for a hunter's blind constructed with one embodiment of the present invention is indicated generally by reference numeral 1 in FIG. 1.

Cover 1 is comprised of a pair of rectangular-shaped sliding panels 20 constructed of light-weight tubing, including end and side tubing 9 and centrally disposed tubing 10, and smooth strand wire 7, laced to and between the tubing for receiving camouflage foliage, as shown.

FIG. 1 shows how the cover 1 is mounted over a ground pit 13. The size of the pit 13 may vary according to the number of hunters.

Figure 2:
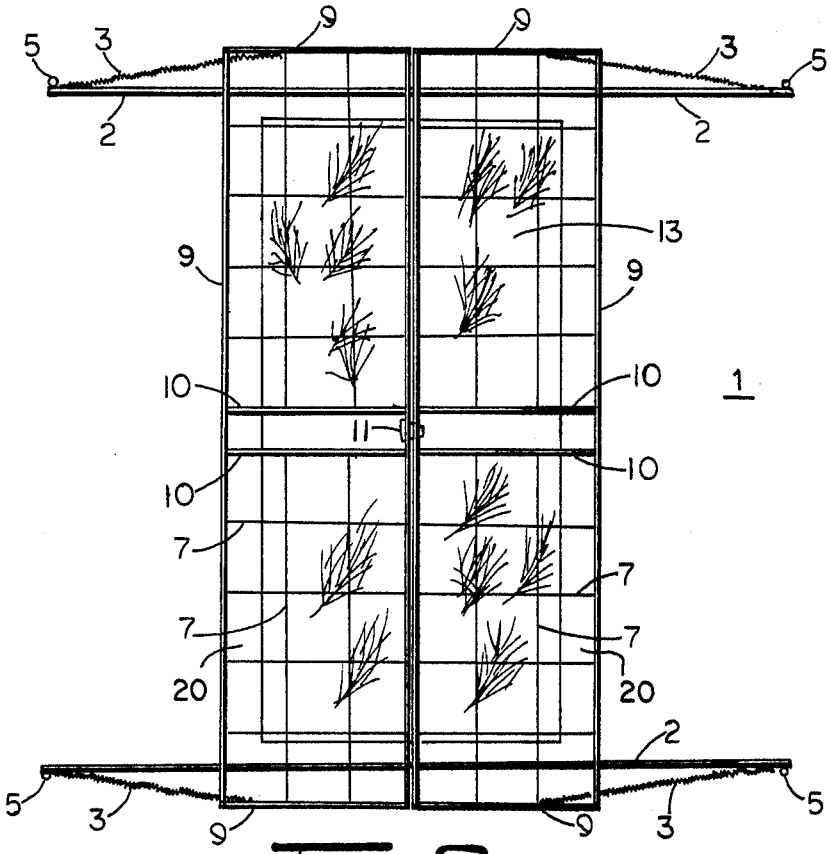
FIG. 2 is an aerial view of the closed cover.
Figure 3:
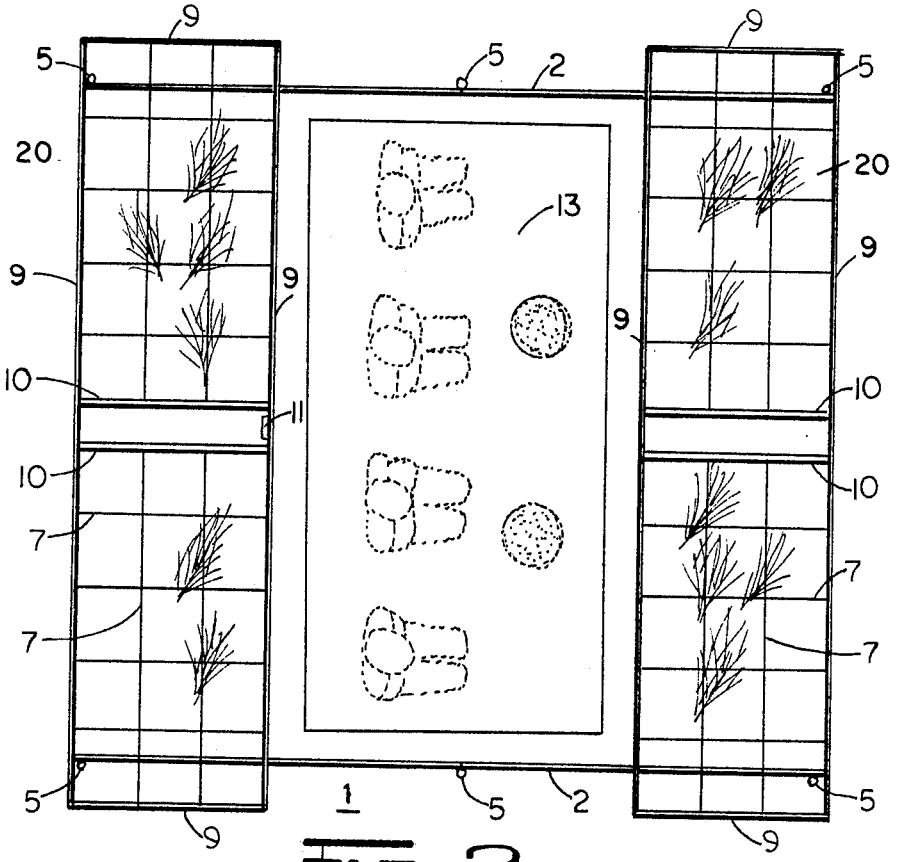
FIG. 3 is an aerial view of the panels in an open position exposing the pit.

The cover 1 is mounted on two guide rails 2, as shown in FIGS. 1, 2 and 3, made of light weight tubing, and secured to six metal stakes 5 which are inserted in the ground at both ends of the pit 13.

Figure 4:
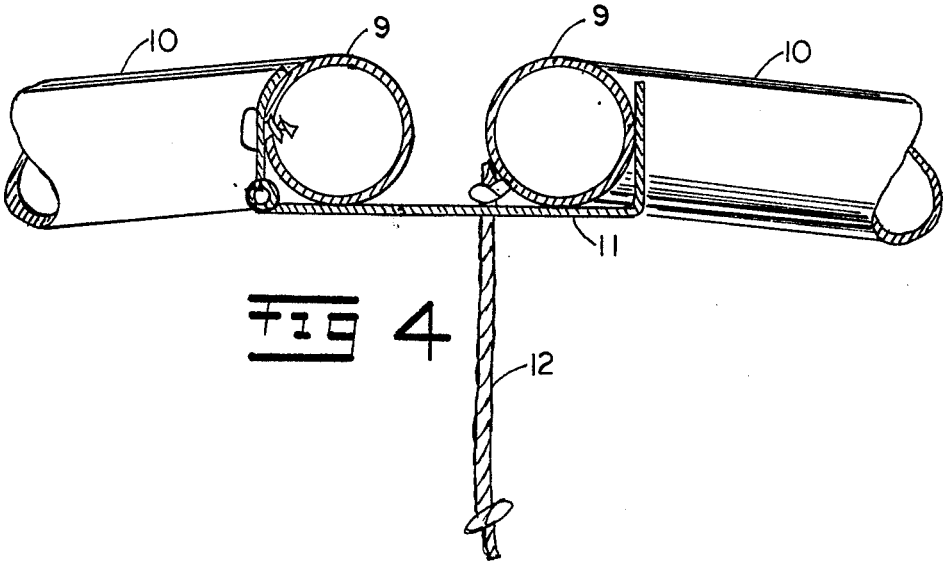
FIG. 4 is a side view of the release mechanism for holding the panels in a closed position.
Figure 5:
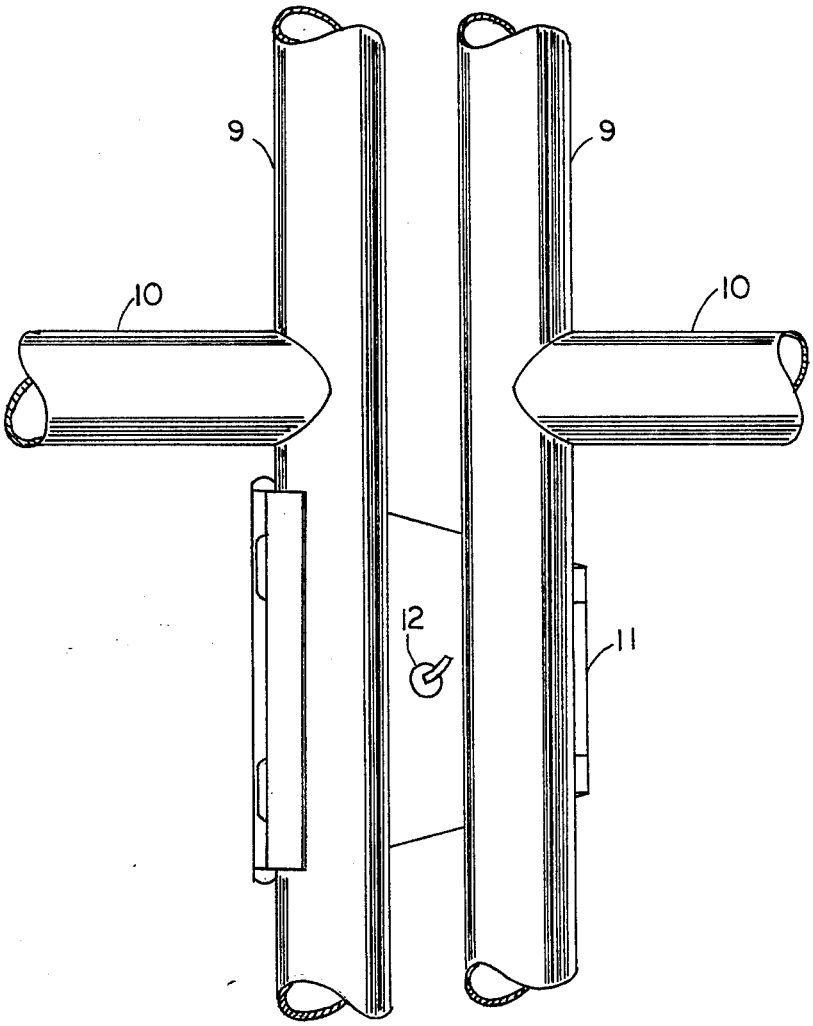
FIG. 5 is an aerial view of the release mechanism of FIG. 4, shown in the closed position.

The cover 1 is quickly moved to the open position from the closed position by pull cord 12 attached to a release mechanism, hook latch 11. Latch 11 is permanently attached to interior side tubing 9 of one sliding panel 20 and slips over the opposing interior side tubing 9 of one sliding panel 20 and slips over the opposing interior side tubing 9 of the other sliding panel 20 when in a locked position, as illustrated in FIGS. 4 and 5.

As illustrated in FIG. 2 the panels 20 are closed by the pressure of four tension springs 3, one at the end of each panel 20 coming from the guide rail 2. When the latch 11 is released, the tension springs 3 cause the panels 20 to fly open exposing the pit 13 as shown in FIG. 3.

In operation, the hunters will place natural foliage over panels 20 for camouflage and after entering pit 13, close panels 20 by means of latch 11. They will then observe any approaching game through the foliage and at the opportune time pull cord 12, releasing panels 20 which are held in close apposition by latch 11. Panels 20 spring open by means of tension springs 3 to offer the hunter obstruction-free viewing in a full 360° radius of the hunting area.

To those skilled in the art to which this invention relates, many changes and modifications will be obvious without departing from the scope of the appended claims.

I claim:

1. A hunting blind which is adapted to be placed over a pit or other enclosure to camouflage the presence of one or more hunters, said hunting blind comprising:

a. a mounting means adapted to be supported on the earth surface and made of light weight tubing, b. a pair of cover panels made of light weight tubing and laced with smooth strand wire adapted to receive camouflage material as required, said panels being slidably disposed on said mounting means, c. a tension spring means comprising at least two spring elements, each spring element secured between one of said cover panels and said mounting means and biasing the cover panels to slide away from each other on the mounting means, and d. a release mechanism holding said panels together in the closed position, whereby upon activation of the release mechanism the pair of cover panels will slide away from each other automatically under the influence of said tension spring means.

2. The invention as described in claim 1 wherein said release mechanism comprises a hook latch secured to one of said panels and operable to temporarily engage in a confining relationship the other of said panels.

3. The invention as described in claim 2 further comprising a pull cord attached to said hook latch and operable to release said hook latch to open said cover panels.

4. The invention as described in claim 1 wherein said mounting means comprises a pair of guide rails, horizontally disposed adjacent the terminal ends of said cover panels.

5. The invention as described in claim 4 wherein said guide rails each contain earth attachment means adjacent their respective terminal ends.

* * * * *